United States Patent [19]

Riglietti

[11] Patent Number: 4,678,122

[45] Date of Patent: Jul. 7, 1987

[54] HAND OPERATED LIQUID ATOMIZER

[75] Inventor: Antonio Riglietti, Bassano Del Grappa, Italy

[73] Assignee: ALTA S.p.A., Vicenza, Italy

[21] Appl. No.: 850,971

[22] Filed: Apr. 11, 1986

[30] Foreign Application Priority Data

Apr. 18, 1985 [IT] Italy ..... 30681/85[U]

[51] Int. Cl.[4] ..... B05B 9/04; B65D 83/14

[52] U.S. Cl. ..... 239/333; 222/383

[58] Field of Search ..... 239/333, 579; 222/383, 222/188, 331, 375, 379

[56] References Cited

U.S. PATENT DOCUMENTS 2,575,632 11/1951 Lipman ..... 222/383

FOREIGN PATENT DOCUMENTS 3314021 10/1984 Fed. Rep. of Germany ..... 239/333

1401321 4/1965 France ..... 239/333

*Primary Examiner*—Andres Kashnikow

*Attorney, Agent, or Firm*—Guido Modiano; Albert Josif

[57] ABSTRACT

The device comprises a body containing a pump adapted for pumping liquid from a container to an atomizer nozzle via a fluid passage conduit and a tube. An auxiliary conduit communicates the interior of the container to an outwardly open hole. A first valve is interposed between the tube and fluid passage conduit to intermittently close the end of the tube upon reciprocation of the pump plunger. A second valve is interposed between the container and the auxiliary conduit, for preventing fluid from passing through the latter upon the device being overturned.

3 Claims, 3 Drawing Figures

HAND OPERATED LIQUID ATOMIZER

BACKGROUND OF THE INVENTION

This invention relates to a device for spraying liquid.

Manually operated liquid sprayers substantially comprise a pump, screwed over the neck of the liquid container, being hand operated and adapted to pump liquid from the container itself and deliver it through a conduit to an atomizing nozzle rigid with the structure that carries the pump.

As the liquid is pumped from the container, the interior space must be restored with air from the outside, so as not to create a vacuum situation which would prevent the liquid from flowing out.

For this reason, spraying devices of this kind have been developed with conduits opening directly to the outside and connected to the inner chamber of the container.

However, these conduits involve a not negligible drawback, due to the fact that in the event of the container being overturned, the liquid flows through the restoration air conduit and is discharged to the outside.

SUMMARY OF THE INVENTION

It is an aim of this invention to obviate the abovementioned drawback by providing a device for spraying liquid wherein the liquid cannot accidentally flow out of the container even with the container overturned.

Within the above aim it is an object of the invention to provide a device for spraying liquid which can be manufactued in a simple and inexpensive way.

A not least object is to provide a device for spraying liquid, which is advantageous from an economic point of view, reliable and safe in use.

These and other objects which will become apparent hereinafter are achieved by a device for spraying liquid, characterized in that it comprises at least one atomizer nozzle, at least one fluid passage conduit, a pump adapted for pumping fluid from a container to said atomizer nozzle via said fluid passage conduit, at least one auxiliary conduit and at least two valves including a first valve and a second valve, said first valve being interposed in said fluid passage conduit ahead of said pump, said second valve being arranged in said auxiliary conduit, adapted for admitting air into said container when liquid is drawn therefrom, said second valve being adapted for closing said auxiliary conduit in the event of said container being overturned.

BRIEF DESCIPTION OF THE DRAWINGS

Further features and advantages of the invention will become apparent from the detailed description of a preferred embodiment thereof, given by way of illustration and not of limitation and being shown in the accompanying drawing sheet, where:

DESCRIPTION OF THE PREFERRED EMBODIMENT

Figure 1:
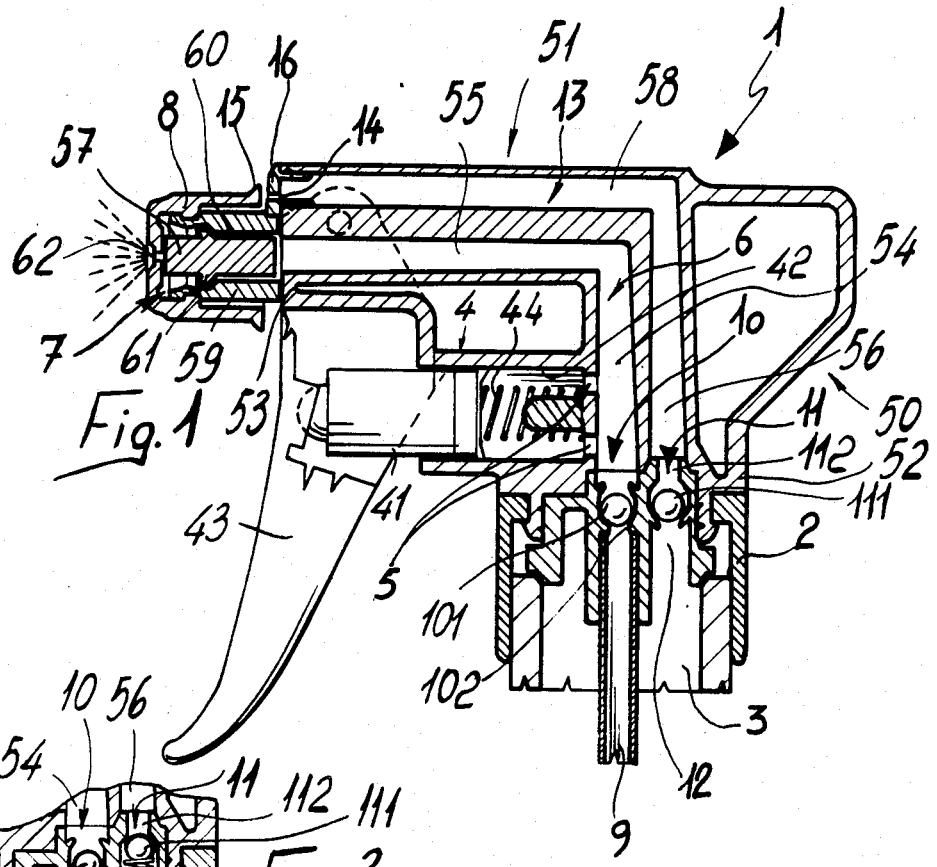
FIG. 1 shows a sectional view of the device for spraying liquid according to the invention, as taken along the longitudinal mid-axis thereof.

With reference to the above-cited drawing figures, the device for spraying liquid according to the invention comprises a main body 1 of substantially L-like form which contains the pumping and spraying members therein and which is associated by means of a ring nut 2 with a container 3 wherein the liquid to be sprayed is introduced.

As visible from the drawing, the main body 1 defines a first body portion 50 and a second body portion 51 extending substantially at right-angle to each other. In particular the first body portion 50 defines at the bottom a connection end 52 for connection to the ring nut 2 and thereby to the container 3, while the second body portion 51 defines (on the left in the drawing) an atomizing end 53.

Said main body 1 has on its interior a pump 4 of the reciprocating plunger type including a plunger 41 adapted for reciprocating movement within the chamber 42 upon actuation of a lever 43 hingedly attached to the main body and against the biasing action of elastic bias means defining a coil spring 44, the chamber 42 extending in the first body portion 50 at a middle position thereof and at right angle thereto and being connected by holes 5 to a fluid passage conduit 6 which at the atomizing end feeds an atomizer or atomizing nozzle 7 provided with a ring nut 8 for adjusting the extent of the atomization.

In detail, the fluid passage conduit 6 defines a first fluid passage conduit part 54 extending in said first body portion 50 and ending at the connection end and a second fluid passage conduit part 55 extending in the second body portion 51 substantially at right-angle to the first part 54 and ending at the atomizing end 53.

The conduit 6 is extended to define, connection at the connection end 52, a tube 9 which extends proximately to the bottom of the container 3 in which it is inserted.

Obviously, the container 3 may be of any convenient shape or volume and hence, the length of the tube 9 will depend upon the parameters of the selected container type.

Between the tube 9 and the fluid passage conduit 6 there is expediently inserted a first valve, advantageously a ball valve 10 comprising a spherical element or ball 101 defining first valve closing member and a valve closure seat 102. As visible, the valve seat 102 is formed in the first passage fluid conduit part 54 substantially at the connection end 52. The valve 10 only allows the liquid to flow from the container towards the pump 4 and hence toward the atomizing nozzle 7, but prevents liquid from returning to the container 3, by virtue of an imposed closed condition of the valve caused by the ball 101 engaging with the valve closure seat 102, in sealed abutment engagement.

Beside said first valve 10 there is also provided a second valve 11 also expediently being of the ball valve type and comprising a sphere or ball 111 defining second valve closing member and a valve closure seat 112. The second valve 11 has its direction of operation reversed with respect to the first valve 10 and opens at one side directly into an upper annular chamber 12, in communication with the interior of the container 3, and opens at its other side into an auxiliary venting conduit 13 which opens outward through a small hole 14, advantageously located as to be selectively covered by a widened flange formation 15 formed on the ring nut 8 for adjusting the atomizing nozzle 7.

As may be seen, the auxiliary venting conduit 13 defines a first venting conduit part 56 extending in the first body portion 50 substantially parallel to the first fluid passage conduit part 54 and ending at the connection end 52 where the second valve 11 is formed, and a second venting conduit part 58 extending in the second body portion 51 substantially parallel to the second fluid passage conduit part 55 and ending at the atomizing end 53. The venting conduit is closed here by a venting stopper 16 engaging with the same conduit 13 and defining said small hole 14.

Furthermore, as visible, the nozzle 7 comprises a cylindrical member 59 defining a through passage 60 aligned with the second fluid passage conduit part 55 and a cylindrical shutter 57 in the through passage 60. The shutter 57 defines peripherally protruding portions 61 engaging with the cylindrical member 59 and closing the through passage 60, while the atomizer nozzle 7 is outwardly encircled by and in screw thread engagement with the ring nut 7 having supply hole 62 aligned with the through passage 60. The flange formation 15 protrudes peripherally and outwardly from the ring nut 7 so as to face the atomizing end 53 and the small hole 14, to thereby close the small hole 14 with the ring nut in the fully screwed-down condition.

In normal operating conditions of the device, the ring nut 8 is slightly unscrewed thus leaving the hole 14 uncovered, thereby air can pass through the auxiliary conduit 13 and hence through the valve 11 which is normally held open by gravity with the container in an upright position, to compensate for the internal vacuum which would form as the liquid is sucked from the container 3 through the fluid passage conduit 6 to the nozzle 7 upon actuation of the pump 4, effected by manually reciprocating the lever 43.

Figure 2:
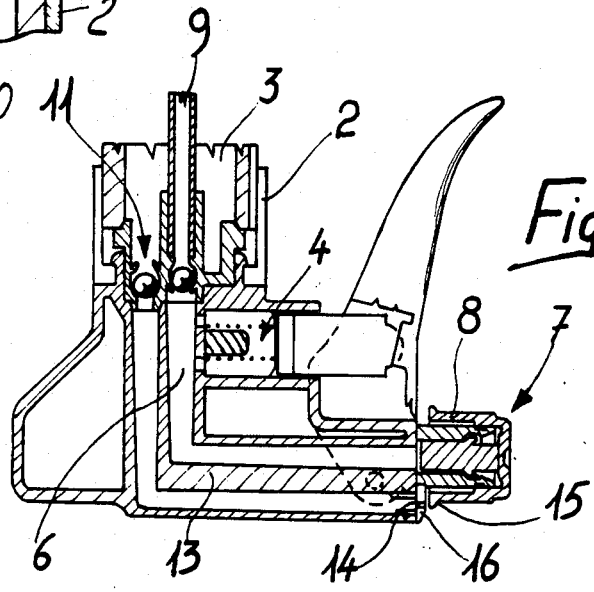
FIG. 2 is a sectional view of the device of FIG. 1, in an overturned condition thereof.

In the upset condition of the device as shown in FIG. 2, the valve 11 will close by virtue of the sphere 111 engaging with the valve closure seat 112 and thus prevent the liquid contained in the container 3 from inadvertently entering the auxiliary conduit 13, and flowing out therefrom.

Figure 3:
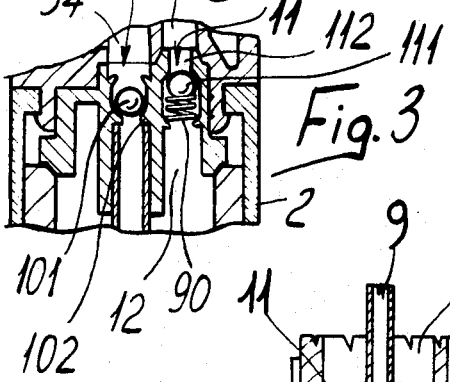
FIG. 3 shows a detail of FIG. 1 in a different embodiment.

Obviously, the spheres 101,111 may each be biased towards their respective closure seats by spring means, and in particular (as visible in the detail of FIG. 3) the second valve 11 could be conveniently provided with a spring to hold it closed even when the container is in the upright position whilst opening would be determined by the negative pressure situation which is generated inside the container 3 as liquid is drawn out by the pump 4.

In the condition of non-use of the sprayer, such as during transportation or storage, the ring nut 8 can be screwed down to cause the flange formation 15 to abut the stopper 16 in sealed abutment engagement relationship therewith to thus close the hole 14 and effectively sealing the auxiliary conduit 13.

Thus, a second safety feature is provided for preventing spillage of the liquid contained in the container 3.

As may be seen, the device is particularly simple both in construction and operation, thus achieving all of the objects set forth.

Expediently, the whole structure may be made of plastic material or be combined with metal parts.

Advantageously, the whole assembly of the device is contained within the main body 1, which may then be mounted to any type of containers.

Of course, any materials, dimensions or contingent shaped may be used according to necessity.

I claim:

1. A hand-operated liquid atomizer comprising a main body of substantially L-like form defining first and second body portions extending at substantially right angle to each other, said first body portion defining a connection end for connection to a liquid container and said second body portion defining an atomizing end; a fluid passage conduit in said main body, said fluid passage conduit defining a first fluid passage conduit part extending in said first body portion and ending at said connection end and a second fluid passage conduit part extending in said second body portion substantially at right angle to said first fluid passage conduit part and ending at said atomizing end; an auxiliary venting conduit in said main body, said venting conduit defining a first venting conduit part extending in said first body portion substantially parallel to said first fluid passage conduit part and ending at said connection end and a second venting conduit part extending in said second body portion substantially parallel to said second fluid passage conduit part and ending at said atomizing end; a venting stopper engaging with and closing said venting conduit at said atomizing end; a small venting hole in said stopper; an atomizer nozzle at said atomizing end, said nozzle having a cylindrical member defining a through passage aligned with said second fluid passage conduit part and a cylindrical shutter in said through passage having peripherally protruding portions for engaging with said cylindrical member and closing said through passage; an atomizer nozzle adjusting ring nut encircling said atomizer nozzle and having a supply hole substantially aligned with said through passage, said ring nut having a peripheral outwardly protruding flange formation facing said atomizing end and said small venting hole, said ring nut being adjustably screw thread engaged with said atomizer nozzle, thereby in a non-use fully screwed down condition of said ring nut said flange formation abutting against said venting stopper and closing said small venting hole; an atomizer pump including a pump chamber extending in said first body portion in a middle position thereof and at right angle thereto, said pump chamber being in communication with said first fluid passage conduit part, a reciprocating pump plunger movable in said pump chamber, elastic bias means in said pump chamber acting against said pump plunger for urging it in a position at least partially extracted from said pump chamber, an actuation lever hingedly attached to said main body and urging said pump plunger towards said pump chamber; first valve means including a first valve seat in said first passage fluid conduit part substantially at said connection end and a first valve closing member in said first valve seat, second valve means including a second valve seat in said first venting conduit part substantially at said connection end and a second valve closing member in said second valve seat.

2. A atomizer according to claim 1, wherein said second valve means is held open by gravity when said main body is maintained in an upright position.

3. An atomizer according to claim 1, wherein said second valve means further comprises spring means acting on said second valve ball for urging said second valve into closed condition.

* * * * *